US008702286B2

(12) United States Patent
Nakazato et al.

(10) Patent No.: US 8,702,286 B2
(45) Date of Patent: Apr. 22, 2014

(54) VEHICLE HEADLIGHT WITH MEANS FOR REDUCING THE PROJECTION OF EXCITATION SOURCE LIGHT

(75) Inventors: Yoshiaki Nakazato, Tokyo (JP); Yoshiaki Nakaya, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 13/309,555

(22) Filed: Dec. 1, 2011

(65) Prior Publication Data

US 2012/0140501 A1 Jun. 7, 2012

(30) Foreign Application Priority Data

Dec. 1, 2010 (JP) ..... 2010-268046

(51) Int. Cl.
*F21S 8/10* (2006.01)

(52) U.S. Cl.
CPC ..... *F21S 48/1388* (2013.01); *F21S 48/1208* (2013.01)
USPC ..... 362/510; 362/516

(58) Field of Classification Search
USPC ..... 362/507–549; 353/98, 81, 31, 37, 50
See application file for complete search history.

(56) References Cited

U.S. PATENT DOCUMENTS 8,314,872 B2 * 11/2012 Hiramoto et al. ..... 348/308
2010/0328632 A1 * 12/2010 Kurosaki et al. ..... 353/98
2011/0063115 A1 * 3/2011 Kishimoto ..... 340/600
2011/0157865 A1 * 6/2011 Takahashi et al. ..... 362/84
2011/0222265 A1 * 9/2011 Drenten et al. ..... 362/84
2011/0249242 A1 * 10/2011 Saitou et al. ..... 353/98
2012/0140504 A1 * 6/2012 Fukai et al. ..... 362/516

FOREIGN PATENT DOCUMENTS

JP 4124445 B2 7/2008

OTHER PUBLICATIONS

List of Potentially Related Pending U.S. Appl. No. 13/309,542 to Yoshiaki Nakazato et al. filed Dec. 1, 2011.

* cited by examiner

*Primary Examiner* — Diane Lee
*Assistant Examiner* — Gerald J Sufleta, II
(74) *Attorney, Agent, or Firm* — Kenealy Vaidya LLP

(57) ABSTRACT

A vehicle light can prevent color variations in a projected image. The vehicle light can include a light source, a wavelength conversion member including a phosphor configured to receive blue light having been emitted from the light source and then emitting white light, and a reflector having a reflection surface that reflects the white light having been emitted from the wavelength conversion member. The reflection surface of the reflector can have an optical structure that can diffuse the blue light incident on the reflection surface from the phosphor, reflect the blue light back to the phosphor, or allow the blue light to pass through the reflection surface to the area rearward thereof.

8 Claims, 15 Drawing Sheets

VEHICLE HEADLIGHT WITH MEANS FOR REDUCING THE PROJECTION OF EXCITATION SOURCE LIGHT

This application claims the priority benefit under 35 U.S.C. §119 of Japanese Patent Application No. 2010-268046 filed on Dec. 1, 2010, which is hereby incorporated in its entirety by reference.

TECHNICAL FIELD

The presently disclosed subject matter relates to a vehicle light.

BACKGROUND ART

Vehicle lights using a semiconductor light-emitting element and a phosphor as the light source have been known and used in vehicle headlights or the like (see Japanese Patent No. 4124445, for example). In such a vehicle light, the phosphor is irradiated with excitation light (for example, blue light) from the semiconductor light-emitting element, so that the phosphor is excited to emit light (for example, yellow light). The light thus obtained is mixed with the excitation light (blue light) to generate visible light (for example, white light). This visible light is projected to the area forward of the vehicle using an optical system, such as a projection lens.

However, in the aforementioned conventional vehicle light, part of the excitation light may be regularly reflected from the phosphor. As a result, color variations may occur partly in the projected image (for example, light distribution pattern) because the part of the excitation light is projected as-is through the projection lens or the like without being mixed with a predetermined color.

SUMMARY

The presently disclosed subject matter was devised in view of these and other problems and features and in association with the conventional art. According to an aspect of the presently disclosed subject matter, a vehicle light can prevent color variations of the projected image (for example, light distribution pattern).

According to another aspect of the presently disclosed subject matter, a vehicle light can include a light source having a semiconductor light-emitting element, a wavelength conversion member including a phosphor configured to receive excitation light having been emitted from the semiconductor light-emitting element and then emitting visible light, and a reflector having a reflection surface that reflects the visible light having been emitted from the wavelength conversion member. In the vehicle light with the above configuration, the reflection surface of the reflector can have an optical structure that can diffuse the excitation light incident on the reflection surface from the phosphor, reflect the excitation light back to the phosphor, or allow the excitation light to pass through the reflection surface to the area rearward thereof.

The vehicle light with the above configuration can further include a condensing optical system that condenses the excitation light having been emitted from the light source onto a first surface of the wavelength conversion member, the reflection surface of the reflector can be disposed to face the first surface of the wavelength conversion member, and the optical structure can be formed in a portion of the reflection surface of the reflector on which the excitation light having been condensed by the condensing optical system and regularly reflected from the wavelength conversion member is incident.

Alternatively, the vehicle light with the above configuration can include a condensing optical system that condenses the excitation light having been emitted from the light source onto a first surface of the wavelength conversion member, the reflection surface of the reflector can be disposed to face a second surface of the wavelength conversion member, and the optical structure can be formed in a portion of the reflection surface of the reflector on which the excitation light having been condensed by the condensing optical system and transmitted through the wavelength conversion member is incident.

In the vehicle light with the above configuration, the semiconductor light-emitting element emits laser light.

According to the presently disclosed subject matter, the reflection surface of the reflector can have an optical structure that can diffuse the excitation light incident on the reflection surface from the wavelength conversion member, reflect the excitation light back to the wavelength conversion member, or allow the excitation light to pass through the reflection surface to the area rearward thereof. Accordingly, when part of the excitation light that has not been converted into the visible light in the wavelength conversion member is incident on the reflection surface, the portion of the excitation light can be diffused, reflected back to the phosphor, or transmitted through the reflection surface to the area rearward thereof due to the optical structure. It is thus possible to prevent the excitation light from being projected out of the vehicle light at the same strength as that at which the excitation light has been emitted from the semiconductor light-emitting element, in turn preventing color variations of the projected image.

BRIEF DESCRIPTION OF DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

A description will now be made below to vehicle lights of the presently disclosed subject matter with reference to the accompanying drawings in accordance with exemplary embodiments.

Figure 1:
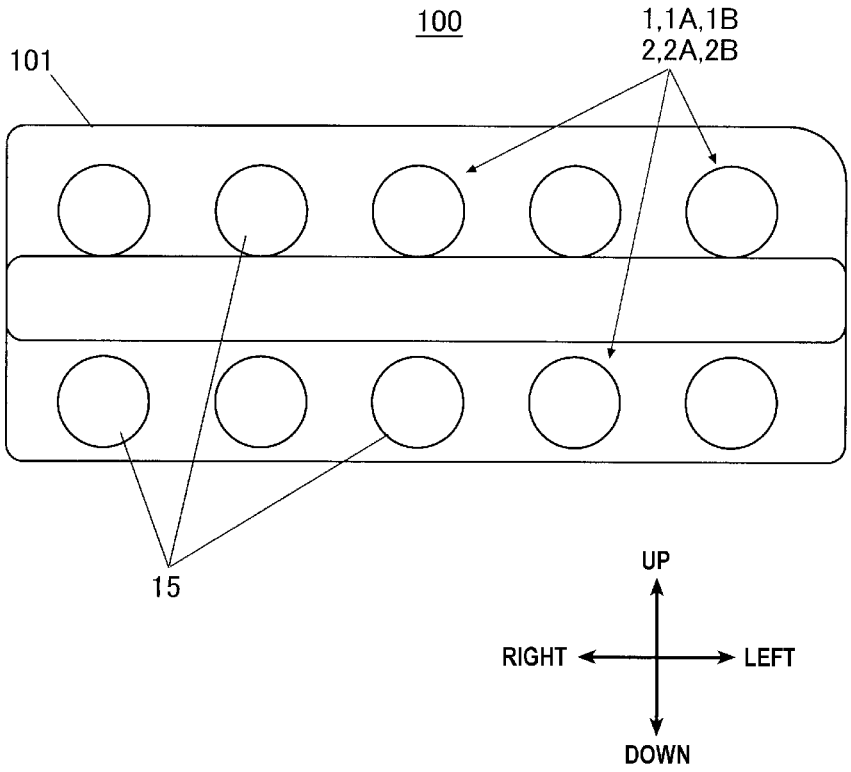
FIG. 1 is an elevation view of a vehicular headlight utilizing a vehicle light in exemplary embodiments.
Figure 2:
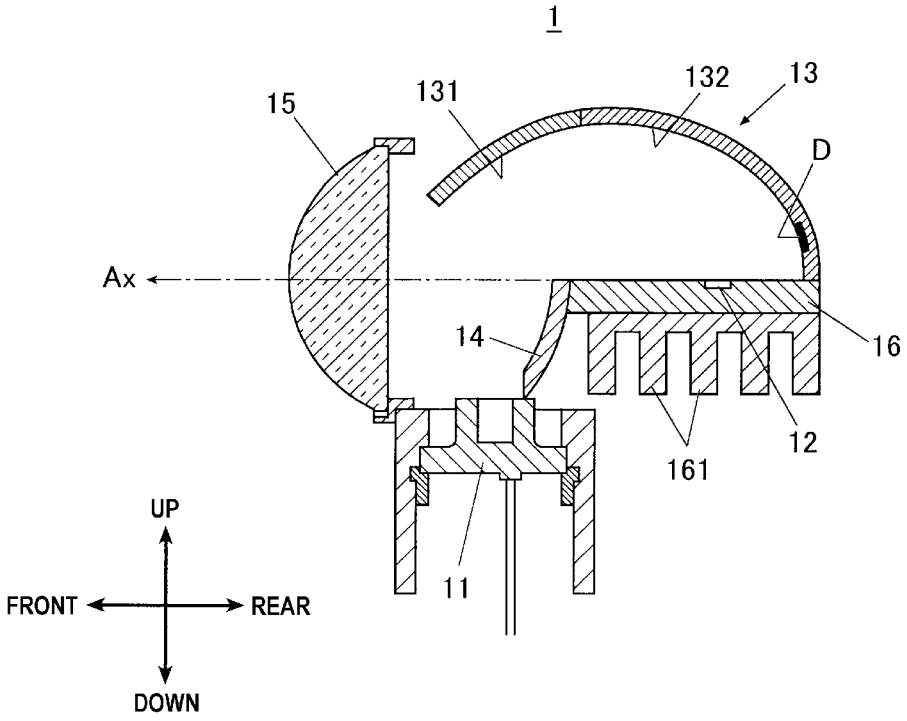
FIG. 2 is a cross-sectional side view of the vehicle light according to an exemplary embodiment made in accordance with principles of the presently disclosed subject matter.

FIG. 1 is an elevation view of a vehicular headlight 100 including a vehicle light 1 according to an exemplary embodiment of the presently disclosed subject matter, and FIG. 2 is a cross-sectional side view of the vehicle light 1.

As shown in FIG. 1, the vehicular headlight 100 can include a plurality of vehicle lights 1, 1A, 1B, etc. disposed in a lighting chamber with the front side of the lighting chamber covered with a light transmissive cover 101. The vehicular headlight 100 can form a low beam light distribution pattern in the area forward of the vehicle using light having been emitted from the plurality of vehicle lights 1, 1A, 1B, etc.

As shown in FIG. 2, the vehicle light 1 can include a light source including a laser diode (hereinafter referred to as an LD) 11, a wavelength conversion member including a phosphor 12, a reflector 13, a shade 14, and a projection lens 15.

The LD 11 can be the semiconductor light-emitting element according to the presently disclosed subject matter, which can upwardly emit a blue laser beam as the excitation light for the phosphor 12. The LD 11 can have a laser outlet that can be elongated in the left to right direction (i.e., in a direction perpendicular to the paper surface of FIG. 2), and can emit a laser beam that is widened in the left to right direction.

The phosphor 12 can be a fluorescence material that is a wavelength conversion material and can be excited to emit yellow light upon receiving blue light having been emitted from the LD 11. The phosphor 12 can be embedded in the top surface of a metal plate 16 disposed rearward and slightly upward of the LD 11. When the phosphor 12 receives the blue light, the blue light scattered in the phosphor 12 can be mixed with yellow light, resulting in white light being radially emitted upward. The phosphor 12 can be disposed so as to receive the blue light having been condensed by a first reflection surface 131 of the reflector 13 described later. The phosphor 12 can also be formed such that the area of the top surface of the phosphor 12 substantially corresponds to the area of the condensed spot of the blue light. Accordingly, the phosphor 12 can emit the white light as if the light is emitted from a point light source having a size substantially the same as that of the condensed spot of the blue light. The metal plate 16 can include a mirror top surface such as an aluminum deposited surface including the inner surface of the recess in which the phosphor 12 is housed. Accordingly, the white light having been emitted downward from the phosphor 12 can be reflected upward. A plurality of cooling fins 161 are provided on the lower surface of the metal plate 16.

The reflector 13 can be disposed such that it extends to cover the LD 11 and the phosphor 12, and can be secured at its rear end to the metal plate 16. This reflector 13 can be formed to be a curved plate that is opened obliquely downward in the forward direction, and the forward portion of its lower surface can define a first reflection surface 131 while the portion rearward of the first reflection surface 131 can define a second reflection surface 132.

The first reflection surface 131 can be a condensing optical system according to the presently disclosed subject matter, and can be disposed above the LD 11, so that the blue light having been emitted upward from the LD 11 can be condensed onto the top surface of the phosphor 12 disposed obliquely rearward and downward with respect to the first reflection surface 131. More specifically, the first reflection surface 131 can condense the blue light from the LD 11 generally at the center of the phosphor 12 in the direction of thickness thereof through the surface thereof. The first reflection surface 131 can be a revolved ellipsoid having a first focal point at or near the position of the outlet of the LD 11 and a second focal point at or near the position of the phosphor 12, and can be configured such that the blue light reflected toward the phosphor 12 is caused to be incident on the phosphor 12 at an incident angle of 45 degrees.

The second reflection surface 132 can be a free-curved surface based on a revolved ellipsoid having a first focal point at or near the position of the phosphor 12, and can be formed such that its eccentricity is gradually increased from the vertical cross-section toward the horizontal cross-section. The second reflection surface 132 can be disposed such that it faces to the top surface of the phosphor 12, and reflects the white light having been emitted upward from the phosphor 12 so that the white light can be focused at or near a position slightly forward of the shade 14 by the curve of the reflecting surface 132 shown in the vertical cross-section while being focused gradually in front of the shade 14 by the curve of the reflecting surface 132 shown in the cross-section toward the horizontal cross-section.

The second reflection surface 132 can include a diffusion portion D formed by roughening the surface thereof. The diffusion portion D can be formed in a portion of the second reflection surface 132 on which the blue light having been condensed by the first reflection surface 131 and regularly reflected from the phosphor 12 is incident (see FIG. 3A). The diffusion portion D can be an optical structure of the presently disclosed subject matter that can diffuse the blue light having been regularly reflected from the phosphor 12 without being converted into the white light and being incident on the second reflection surface 132.

The shade 14 can be a light shielding member formed integrally with the metal plate 16 at the front end thereof. This shade 14 can shield part of the white light reflected from the second reflection surface 132 of the reflector 13 to form the cutoff line of a low beam light distribution pattern. Like the top surface of the metal plate 16, the top surface of the shade 14 can also be an aluminum deposited surface, and can be configured to reflect part of the white light reflected from the second reflection surface 132 of the reflector 13 toward the projection lens 15 located forward of the shade 14.

The projection lens 15 can be an aspheric plano-convex lens with the convex surface thereof facing forward. The projection lens 15 is disposed forward of the phosphor 12 and the reflector 13 such that the phosphor 12 is located on the optical axis Ax extending in the back-and-forth direction. The projection lens 15 can have an object-side focal point located at or near the upper end of the shade 14 to project the white light reflected from the second reflecting surface 132 of the reflector 13 as forward illumination for the vehicle while the white light image is inverted.

Figure 3A:
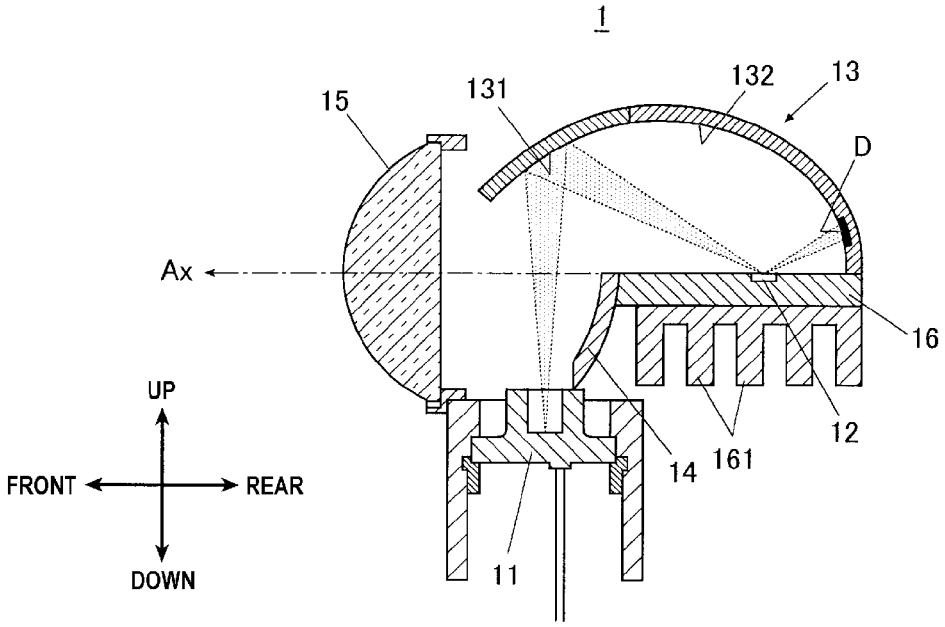
FIGS. 3A and 3B are cross-sectional side views illustrating an optical path of the vehicle light according to the exemplary embodiment of FIG. 2.

In the vehicle light 1 having the above configuration, as shown in FIG. 3A, the blue light (excitation light) emitted from the LD 11 can be condensed by the first reflection surface 131 of the reflector 13 onto the phosphor 12, resulting in almost all the blue light being converted into the white light and emitted upward. In this process, although part of the blue light condensed onto the phosphor 12 may be regularly reflected from the phosphor 12 toward the second reflection surface 132 without being converted into the white light, that part of light can be received and diffused by the diffusion portion D of the second reflection surface 132. As a result, the blue light can be prevented from being projected through the projecting lens 15 at the same strength as that at which the light has been emitted from the LD 11.

Figure 3B:
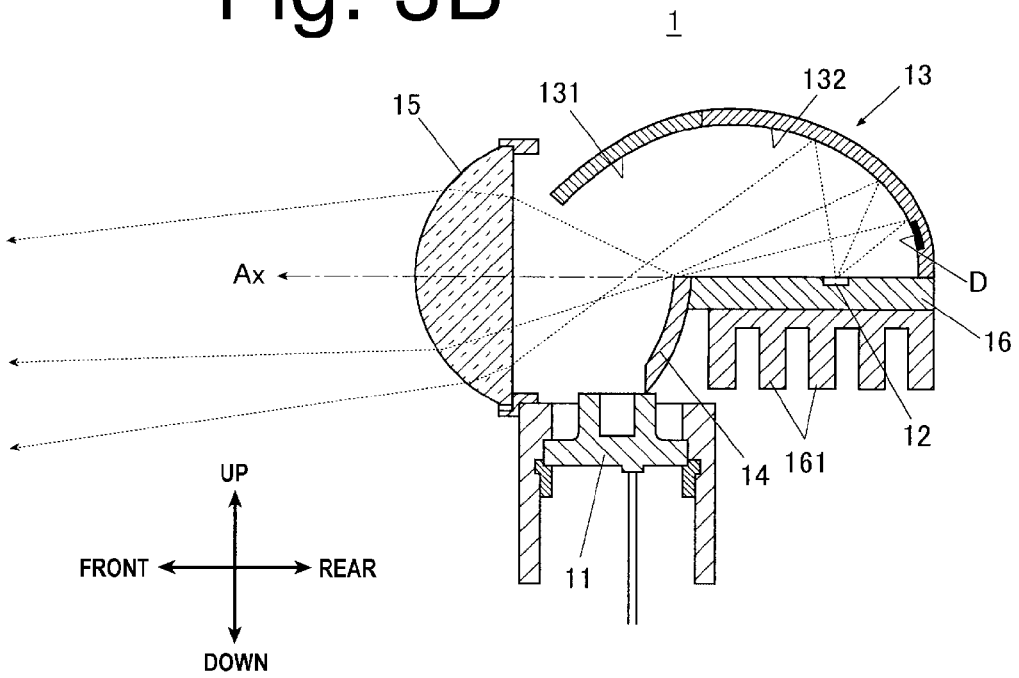

As shown in FIG. 3B, the white light having been emitted from the phosphor 12 can be reflected from the second reflection surface 132 of the reflector 13, and can be provided as forward illumination for the vehicle through the projection lens 15. In this process, part of the white light incident on the lower portion of the projection lens 15 can be shielded by the shade 14 and inversely projected by the projection lens 15, resulting in a low beam light distribution pattern being formed in which light that is output upward beyond the cutoff line is shielded.

In the above vehicle light 1, the blue light having been regularly reflected from the phosphor 12 without being converted into the white light in the phosphor 12 can be diffused by the diffusion portion D. Therefore, the blue light can be prevented from being projected through the projection lens 15 out of the vehicle light at the same strength as that at which the light has been emitted from the LD 11. As a result, the color variations of the projected image (i.e., the low beam light distribution pattern) can be prevented.

Furthermore, in terms of safety (eye safety) for the human body, the blue laser beam light would not necessarily be emitted out of the vehicle light. In this context, the blue light can be prevented from being transmitted through the projection lens 15 at the same high strength at which the blue light has been emitted from the LD 11, thus ensuring the safety.

Next, a vehicle light 1A according to a variation of the vehicle light 1 in the above described exemplary embodiment will be described. The same components as those of the above described exemplary embodiment will be denoted by the same reference numerals, and a description will be omitted.

Figure 4:
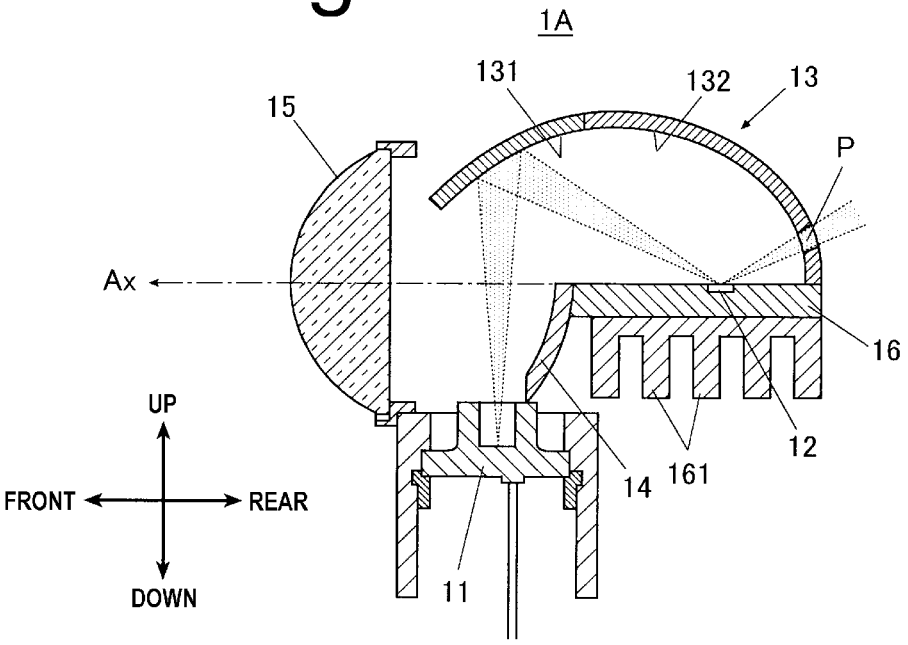
FIG. 4 is a cross-sectional side view of a vehicle light according to a variation of an exemplary embodiment.

FIG. 4 is a cross-sectional side view of the vehicle light 1A according to a variation.

As shown in FIG. 4, the vehicle light 1A can include, instead of the diffusion portion D in the above described exemplary embodiment, a transmission portion P as an optical structure according to the presently disclosed subject matter.

This transmission portion P can be an opening for light transmissions formed in a portion of the second reflection surface 132 on which the blue light having been condensed by the first reflection surface 131 and regularly reflected from the phosphor 12 can be incident. The transmission portion P allows the blue light having been regularly reflected from the phosphor 12 without being converted into the white light and incident on the second reflection surface 132 to pass through the second reflection surface 132 to the area rearward thereof.

In the above vehicle light 1A, the blue light having been regularly reflected from the phosphor 12 without being converted into the white light can be transmitted through the second reflection surface 132 to the area rearward thereof by the transmission portion P. Accordingly, the blue light can be prevented from being projected through the projection lens 15 out of the vehicle light. Therefore, as in the above described exemplary embodiment, not only the color variations of the projected image can be prevented, but also the safety of human bodies can be enhanced.

Next, a vehicle light 1B according to another variation of the vehicle light 1 in the above described exemplary embodiment will be described. The same components as those in the above described exemplary embodiment will be denoted by the same reference numerals, and a description will be omitted.

Figure 5:
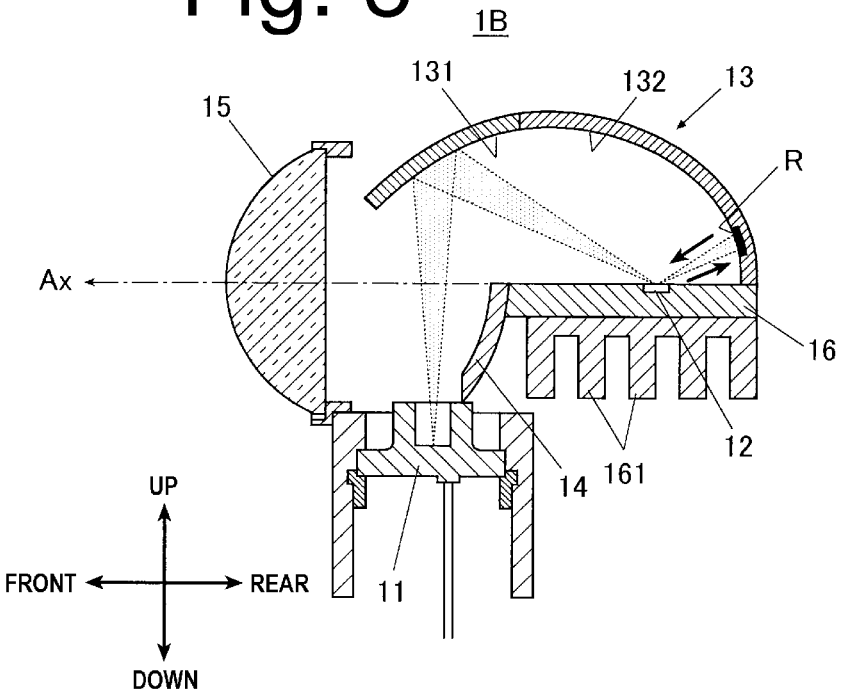
FIG. 5 is a cross-sectional side view of a vehicle light according to another variation of an exemplary embodiment.

FIG. 5 is a cross-sectional side view of the vehicle light 1B according to another variation.

As shown in FIG. 5, the vehicle light 1B can include, instead of the diffusion portion D in the above described exemplary embodiment, a reflection portion R as an optical structure according to the presently disclosed subject matter.

The reflection portion R can be a third reflection surface portion formed in a portion of the second reflection surface 132 on which the blue light having been condensed by the first reflection surface 131 and regularly reflected from the phosphor 12 can be incident. This reflection portion R can reflect the blue light having been regularly reflected from the phosphor 12 without being converted into the white light and incident on the second reflection surface 132 back to the phosphor 12.

In the above vehicle light 1B, the blue light having been regularly reflected from the phosphor 12 without being converted into the white light can be reflected from the reflection portion R back to the phosphor 12. Accordingly, the blue light can be prevented from being projected through the projection lens 15 out of the vehicle light. Therefore, as in the above described exemplary embodiment, not only the color variations of the projected image can be prevented, but also the safety of human bodies can be enhanced.

Furthermore, reflecting the blue light once regularly reflected from the phosphor 12 without being converted into the white color back to the phosphor 12 enables the blue light to be converted into the white light more efficiently. As a result, the light use efficiency can be improved when compared to the vehicle light 1 according to the exemplary embodiment and the vehicle light 1A according to a variation thereof.

Another exemplary embodiment of the presently disclosed subject matter will now be described. The same components as those in the above described exemplary embodiment will be denoted by the same reference numerals, and a description will be omitted.

As shown in FIG. 1, the vehicular headlight 100 can include a plurality of vehicle lights 2, 2A, 2B, etc. according to this exemplary embodiment disposed in the lighting chamber with the front side thereof covered with a light transmissive cover 101. The vehicular headlight 100 can form a low beam light distribution pattern in the area forward of the vehicle using light having been emitted from the plurality of vehicle lights 2, 2A, 2B, etc.

Figure 6:
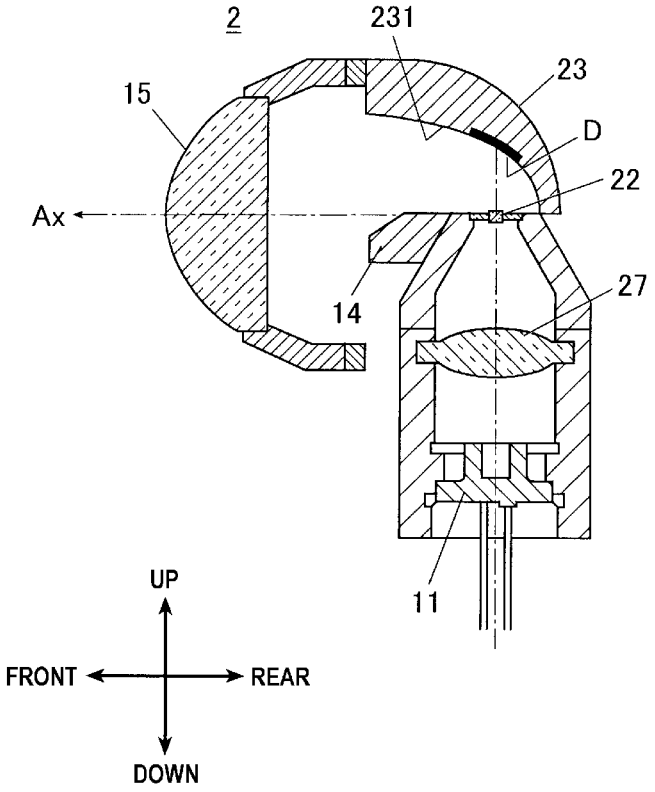
FIG. 6 is a cross-sectional side view of a vehicle light according to the another exemplary embodiment.

FIG. 6 is a cross-sectional side view of the vehicle light 2.

As shown in FIG. 6, in addition to the LD 11, the shade 14, and the projection lens 15, all of which can be configured as in the above described exemplary embodiment, the vehicle light 2 can include a wavelength conversion member including a phosphor 22, a reflector 23, and a condensing lens 27.

The vehicle light 2 differs from the vehicle light 1 according to the above described exemplary embodiment in that the vehicle light 2 is configured such that the blue light is transmitted through the phosphor 22 from the lower surface to the top surface thereof.

The condensing lens 27 can be an condensing optical system according to the presently disclosed subject matter, and can be disposed above the LD 11 such that the blue light having been emitted upward from the LD 11 can be condensed onto the lower surface of the phosphor 22 disposed above the condensing lens 27. More specifically, the condensing lens 27 can focus the blue light from the LD 11 generally at the center of the phosphor 22 in the direction of thickness thereof through the surface thereof.

The phosphor 22 can be formed of the same fluorescent material as the phosphor 12 in the above described exemplary embodiment, and can be disposed above the condensing lens 27 with the upper and lower surfaces of the phosphor 22 exposed. This phosphor 22 is configured to receive the blue light having been emitted from the LD 11 and condensed by the condensing lens 27 through its lower surface and radially emit white light upward. The phosphor 22 can be formed such that the areas of the lower and top surfaces thereof substantially correspond to that of the condensed spot of the blue light.

The reflector 23 can be formed into a curved plate that is opened obliquely downward in the forward direction, and can be disposed so as to cover the phosphor 22 from above. The lower surface of the reflector 23 can include a reflection surface 231 facing to the top surface of the phosphor 22.

The reflection surface 231 can be a free-curved surface based on a revolved ellipsoid having a first focal point at or near the position of the phosphor 22, and can be formed such that its eccentricity is gradually increased from the vertical cross-section toward the horizontal cross-section. This reflection surface 231 can reflect the white light having been emitted upward from the phosphor 22 so that the white light can be focused at or near a position slightly forward of the shade 14 by the curve of the reflecting surface 231 shown in the vertical cross-section while being focused gradually in front of the shade 14 by the curve of the reflecting surface 231 shown in the cross-section toward the horizontal cross-section.

The reflection surface 231 can also include a diffusion portion D formed by roughening the surface thereof. The diffusion portion D can be formed in a portion of the reflection surface 231 on which the blue light having been condensed by the condensing lens 27 and transmitted upward through the phosphor 22 is incident (see FIG. 7A). This diffusion portion D can be an optical structure of the presently disclosed matter that can diffuse the blue light having been transmitted through the phosphor 22 without being converted into the white light in the phosphor 22 and incident on the reflection surface 231.

Figure 7A:
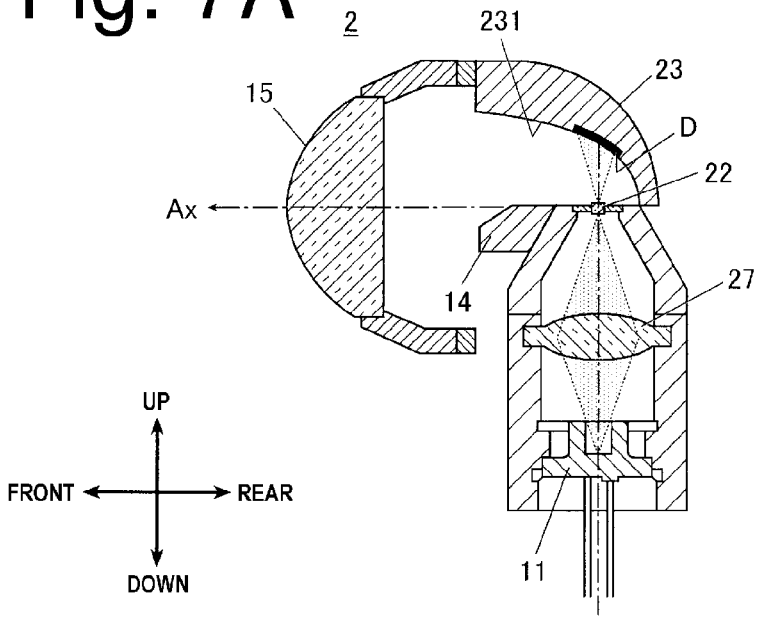
FIGS. 7A and 7B are cross-sectional side views illustrating the optical path of the vehicle light according to the exemplary embodiment of FIG. 6.

In the vehicle light 2 having the above structure, as shown in FIG. 7A, the blue light (excitation light) emitted from the LD 11 can be condensed by the condensing lens 27 onto the phosphor 22, resulting in almost all the blue light being converted into the white light and emitted upward. In this process, although part of the blue light condensed onto the phosphor 22 may be transmitted through the phosphor 22 to the reflection surface 231 without being converted into the white light, that part of light can be received and diffused by the diffusion portion D of the reflection surface 231. As a result, the blue light can be prevented from being projected through the projection lens 15 at the same strength as that at which the light has been emitted from the LD 11.

Figure 7B:
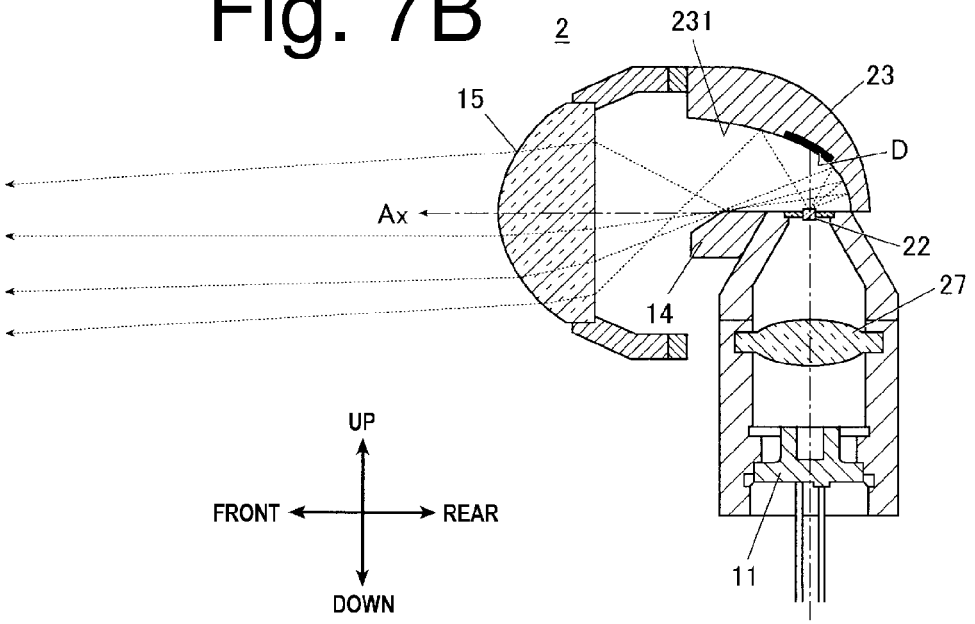

As shown in FIG. 7B, the white light having been emitted from the phosphor 22 can be reflected from the reflection surface 231 of the reflector 23 and can be projected through the projection lens 15 toward the area forward of the vehicle. As a result, a low beam light distribution pattern can be formed as in the above described exemplary embodiment.

In the above vehicle light 2, the same advantages as the vehicle light 1 according the above described exemplary embodiment can be obtained. More specifically, the blue light having been transmitted through the phosphor 22 without being converted into the white light in the phosphor 22 can be diffused by the diffusion portion D. Therefore, the blue light can be prevented from being projected out of the vehicle light through the projection lens 15 at the same strength as that at which the light has been emitted from the LD 11. As a result, not only the color variations of the projected image (i.e., the low beam light distribution pattern) can be prevented, but also the safety of human bodies can be enhanced.

Next, a vehicle light 2A according to a variation of the vehicle light 2 in the above described exemplary embodiment will be described. The same components as those in the above described exemplary embodiment will be denoted by the same reference numerals, and a description will be omitted.

Figure 8:
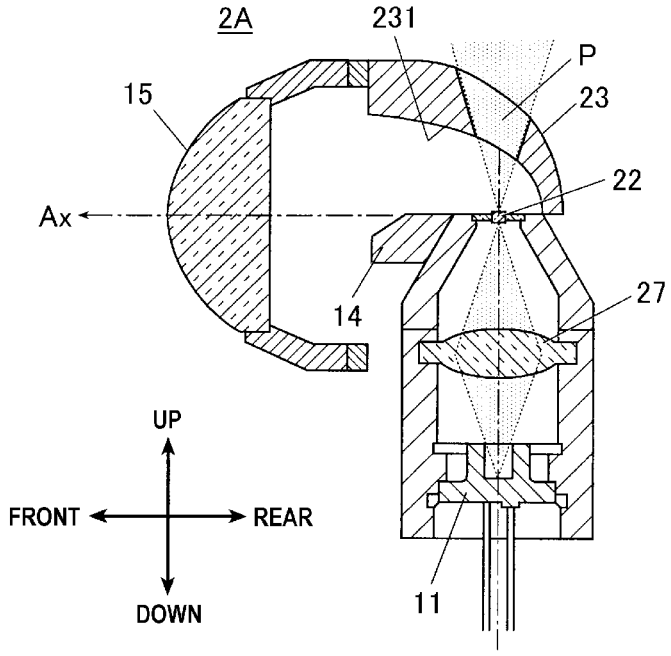
FIG. 8 is a cross-sectional side view of a vehicle light according to a variation of the exemplary embodiment of FIG. 6.

FIG. 8 is a cross-sectional side view of the vehicle light 2A according to a variation.

As shown in FIG. 8, the vehicle light 2A can include, instead of the diffusion portion D of the above described exemplary embodiment, a transmission portion P as an optical structure according to the presently disclosed subject matter.

The transmission portion P can be an opening for light transmissions formed in a portion of the reflection surface 231 on which the blue light having been condensed by the condensing lens 27 and transmitted through the phosphor 22 can be incident. The transmission portion P allows the blue light having been transmitted through the phosphor 22 without being converted into the white light in the phosphor 22 and incident on the reflection surface 231 to pass through the reflection surface 231 to the area rearward thereof.

In the above vehicle light 2A, the blue light having been transmitted through the phosphor 22 without being converted into the white light in the phosphor 22 can be transmitted through the reflection surface 231 to the area rearward thereof through the transmission portion P. Therefore, the blue light can be prevented from being projected through the projection lens 15 out of the vehicle light. As a result, as in the above described exemplary embodiment, not only the color variations of the projected image can be prevented, but also the safety of human bodies can be enhanced.

Next, a vehicle light 2B according to another variation of the vehicle light 2 in the above described exemplary embodiment will be described. The same components as those in the above described exemplary embodiment will be denoted by the same reference numerals, and a description will be omitted.

Figure 9:
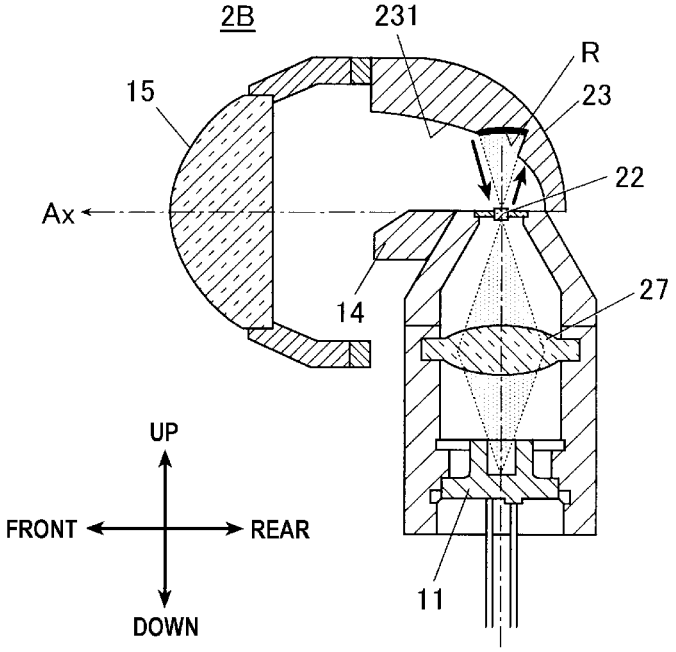
FIG. 9 is a cross-sectional side view of a vehicle light according to another variation of the exemplary embodiment of FIG. 6.

FIG. 9 is a cross-sectional side view of the vehicle light 2B according to another variation.

As shown in FIG. 9, the vehicle light 2B can include, instead of the diffusion portion D according to the above described exemplary embodiment, a reflection portion R as an optical structure according to the presently disclosed subject matter.

The reflection portion R can be a third reflection surface portion formed in a portion of the reflection surface 231 on which the blue light having been condensed by the condensing lens 27 and transmitted through the phosphor 22 can be incident. This reflection portion R can reflect the blue light having been transmitted through the phosphor 22 without being converted into the white light in the phosphor 22 and incident on the reflection surface 231 back to the phosphor 22.

In the above vehicle light 2B, the blue light having been transmitted through the phosphor 22 without being converted into the white light in the phosphor 22 can be reflected back to the phosphor 22 by the reflection portion R. Therefore, the blue light can be prevented from being projected through the projection lens 15 out of the vehicle light. Therefore, as in the above described exemplary embodiment, not only the color variations of the projected image can be prevented, but also the safety of human bodies can be enhanced.

Furthermore, reflecting the blue light once transmitted through the phosphor 22 without being converted into the white light back to the phosphor22 enables the blue light to be converted into the white light more efficiently. As a result, the light use efficiency can be improved when compared to the vehicle light 2 according to the above described exemplary embodiment and the vehicle light 2A according to the variation thereof.

Another exemplary embodiment of the presently disclosed subject matter will now be described. The same components as those in the above described exemplary embodiments will be denoted by the same reference numerals, and a description will be omitted.

Figure 10:
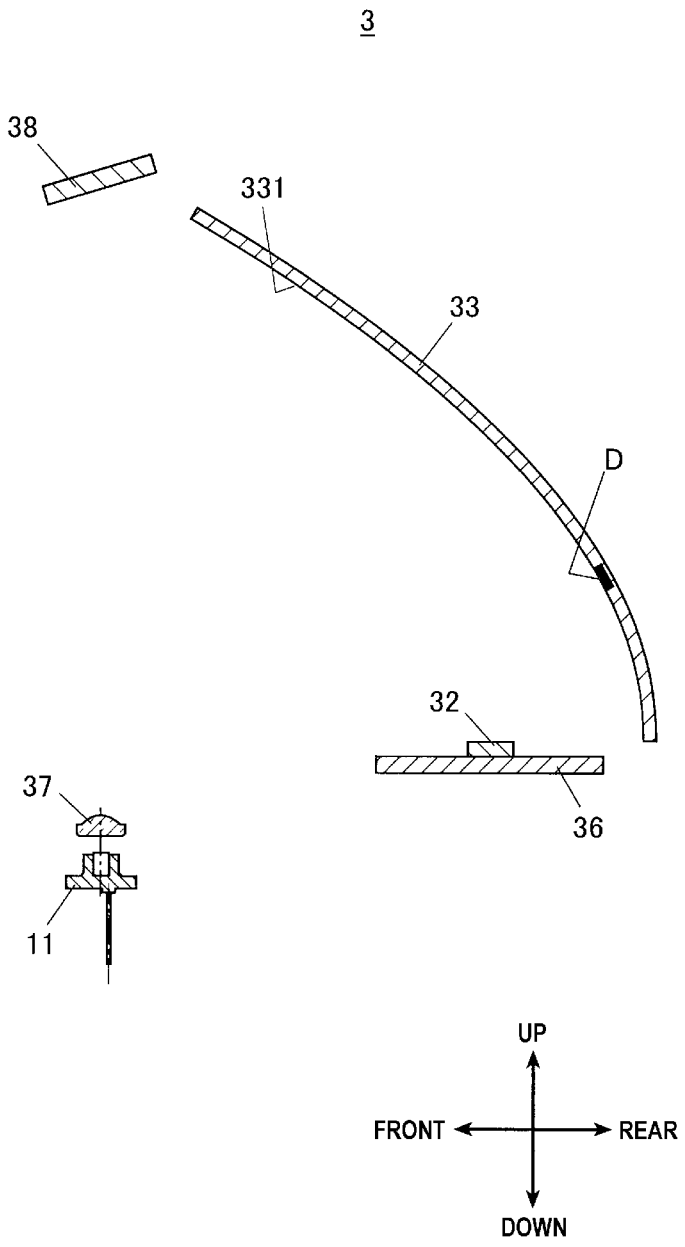
FIG. 10 is a cross-sectional side view of a vehicle light according to another exemplary embodiment.

FIG. 10 is a cross-sectional side view of a vehicle light 3 according to another exemplary embodiment of the disclosed subject matter.

As shown in FIG. 10, in addition to the LD 11 configured as in the above described exemplary embodiment, the vehicle light 3 can include a condensing lens 37, a reflection minor 38, a wavelength conversion member including a phosphor 32, and a reflector 33.

The condensing lens 37 and the reflection mirror 38 can be a condensing optical system according to the presently disclosed subject matter that can be disposed above the LD 11 and that can condense the blue light having been emitted upward by the LD 11 onto the top surface of the phosphor 32 located obliquely rearward and downward of the reflection minor 38. More specifically, the condensing lens 37 can be disposed directly above the LD 11 while the reflection minor 38 can be located at a position above the condensing lens 27 and near the upper end of the reflector 33. In this manner, the blue light from the LD 11 can be condensed by the condensing lens 37 and reflected from the reflection minor 38 such that the blue light can be condensed into the phosphor 32 generally at the center of the phosphor 32 in the direction of thickness thereof through the surface thereof.

The phosphor 32 can be formed of the same fluorescent material as the phosphor 12 in the above described exemplary embodiment, and can be disposed on the top surface of a metal plate 36 located at a position rearward and slightly upward of the LD 11. This phosphor 32 is configured to receive the blue light having been emitted from the LD 11 and condensed by the condensing lens 37 and the reflection minor 38 through its top surface and radially emit white light upward through the top surface. Furthermore, the phosphor 32 can also be formed such that the area of its top surface substantially corresponds to that of the condensed spot of the blue light.

The reflector 33 can be formed into a curved plate that is opened in the forward direction, and can be disposed so as to cover the phosphor 32 from above. The lower surface (front surface) of the reflector 33 can include a reflection surface 331 facing to the top surface of the phosphor 32.

The reflection surface 331 can be a free-curved surface based on a revolved ellipsoid having a focal point at or near the position of the phosphor 32, and can reflect the white light having been emitted upward from the phosphor 32 toward the area forward of the vehicle.

Furthermore, the reflection surface 331 can include a diffusion portion D formed by roughening the surface thereof. The diffusion portion D can be formed in a portion of the reflection surface 331 on which the blue light having been condensed by the condensing lens 37 and the reflection minor 38 and regularly reflected from the phosphor 32 can be incident (see FIG. 11A). This diffusion portion D can be an optical structure according to the presently disclosed subject matter that can diffuse the blue light having been regularly reflected from the phosphor 32 without being converted into the white light in the phosphor 32 and incident on the reflection surface 331.

Figure 11B:
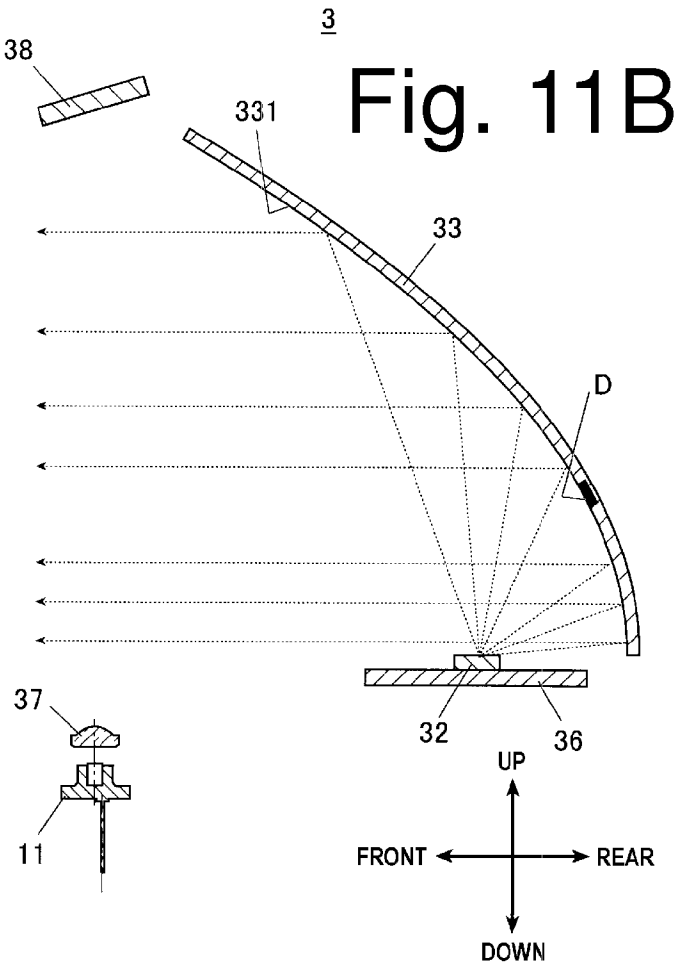
FIGS. 11A and 11B are cross-sectional side views illustrating the optical path in the vehicle light according to the exemplary embodiment of FIG. 10.
Figure 11A:
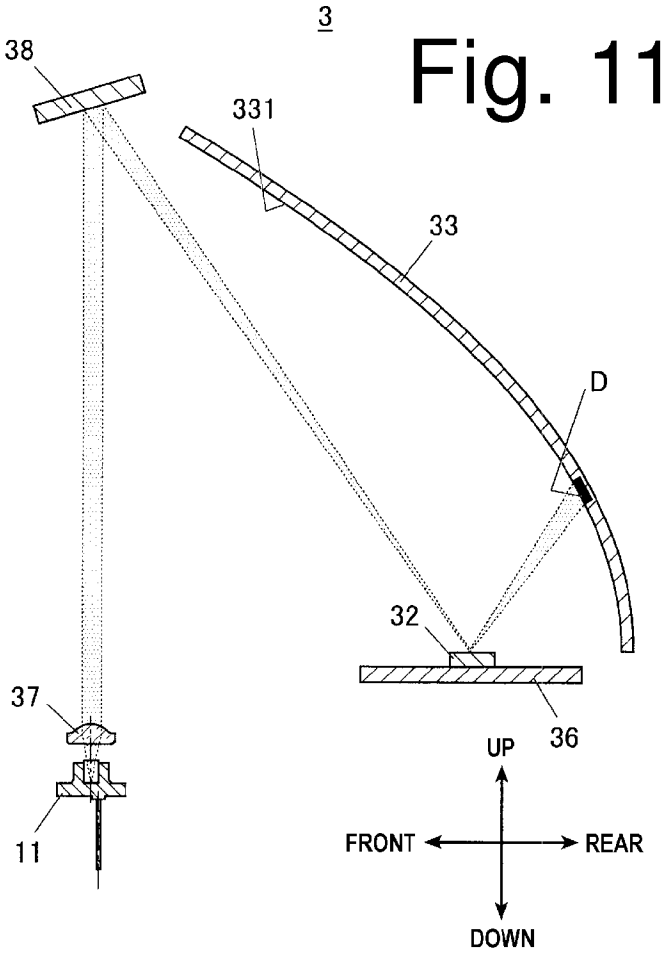

In the vehicle light 3 having the above configuration, as shown in FIG. 11A, the blue light (excitation light) emitted from the LD 11 can be condensed by the condensing lens 37 and the reflection mirror 38 onto the phosphor 32, resulting in almost all the blue light being converted into the white light and emitted upward. In this process, although part of the blue light having been condensed onto the phosphor 32 may be regularly reflected from the phosphor 32 toward the reflection surface 331 without being converted into the white light, that part of light can be received and diffused by the diffusion portion D of the reflection surface 331. As a result, the blue light can be prevented from being projected out of the vehicle light at the same strength as that at which the light has been emitted from the LD 11.

As shown in FIG. 11B, the white light emitted from the phosphor 32 can be reflected from the reflection surface 331 of the reflector 33 excluding the diffusion portion D, and can be projected to the area forward of the vehicle. As a result, a predetermined high beam light distribution pattern can be formed.

In the above vehicle light 3, the same advantages as the vehicle light 1 according to the above described exemplary embodiment can be obtained. More specifically, the blue light having been regularly reflected from the phosphor 32 without being converted into the white light in the phosphor 32 can be diffused by the diffusion portion D. Therefore, the blue light can be prevented from being projected out of the vehicle light at the same strength as that at which the light has been emitted from the LD 11. As a result, not only the color variations of the projected image can be prevented, but also the safety of human bodies can be enhanced.

Next, a vehicle light 3A according to a variation of the vehicle light 3 in the above described exemplary embodiment will be described. The same components as those in the above described exemplary embodiment will be denoted by the same reference numerals, and a description will be omitted.

Figure 12:
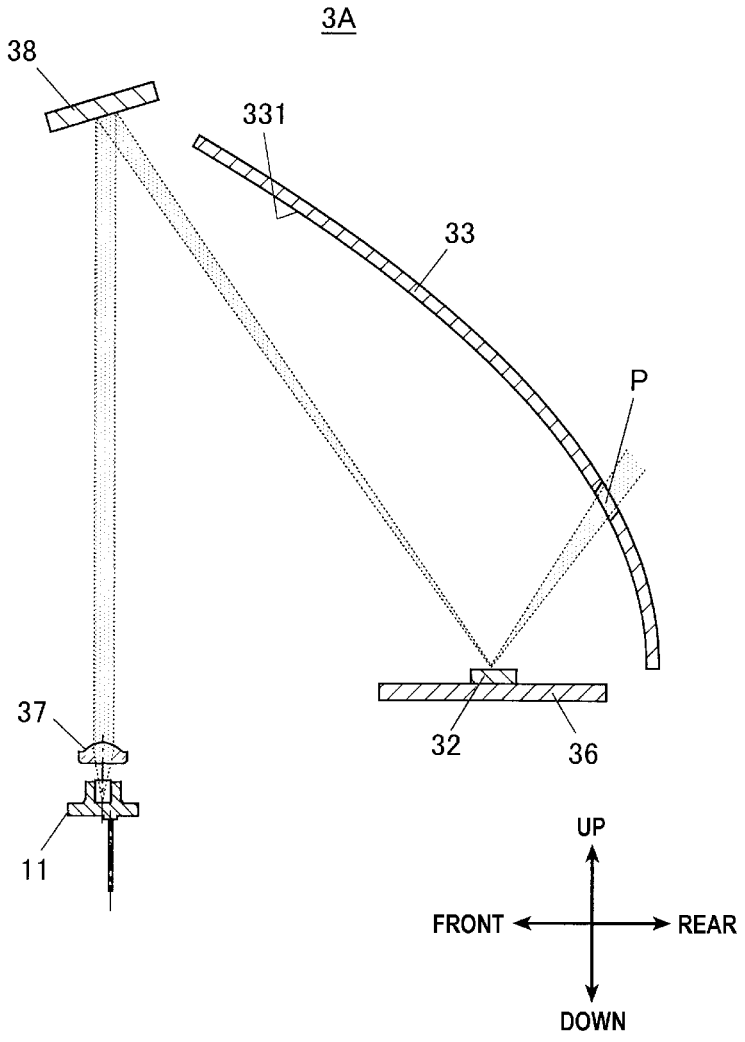
FIG. 12 is a cross-sectional side view of a vehicle light according to a variation of the exemplary embodiment of FIG. 10.

FIG. 12 is a cross-sectional side view of the vehicle light 3A according to a variation.

As shown in FIG. 12, the vehicle light 3A can include, instead of the diffusion portion D in the above described exemplary embodiment, a transmission portion P as an optical structure according to the presently disclosed subject matter.

The transmission portion P can be an opening for transmission formed in a portion of the reflection surface 331 on which the blue light having been condensed by the condensing lens 37 and the reflection mirror 38 and regularly reflected from the phosphor 32 can be incident. This transmission portion P allows the blue light having been regularly reflected from the phosphor 32 without being converted into the white light and incident on the reflection surface 331 to pass through the reflection surface 331 to the area rearward thereof.

In the above vehicle light 3A, the blue light having been regularly reflected from the phosphor 32 without being converted into the white light can be transmitted through the reflection surface 331 to the area rearward thereof by means of the transmission portion P. Therefore, the blue light can be prevented from being projected to the area forward of the vehicle out of the vehicle light. As a result, as in the above described exemplary embodiment, not only the color variations of the projected image can be prevented, but also the safety of human bodies can be enhanced.

Next, a vehicle light 3B according to another variation of the vehicle light 3 in the above described exemplary embodiment will be described. The same components as those in the above described exemplary embodiment will be denoted by the same reference numerals, and a description will be omitted.

Figure 13:
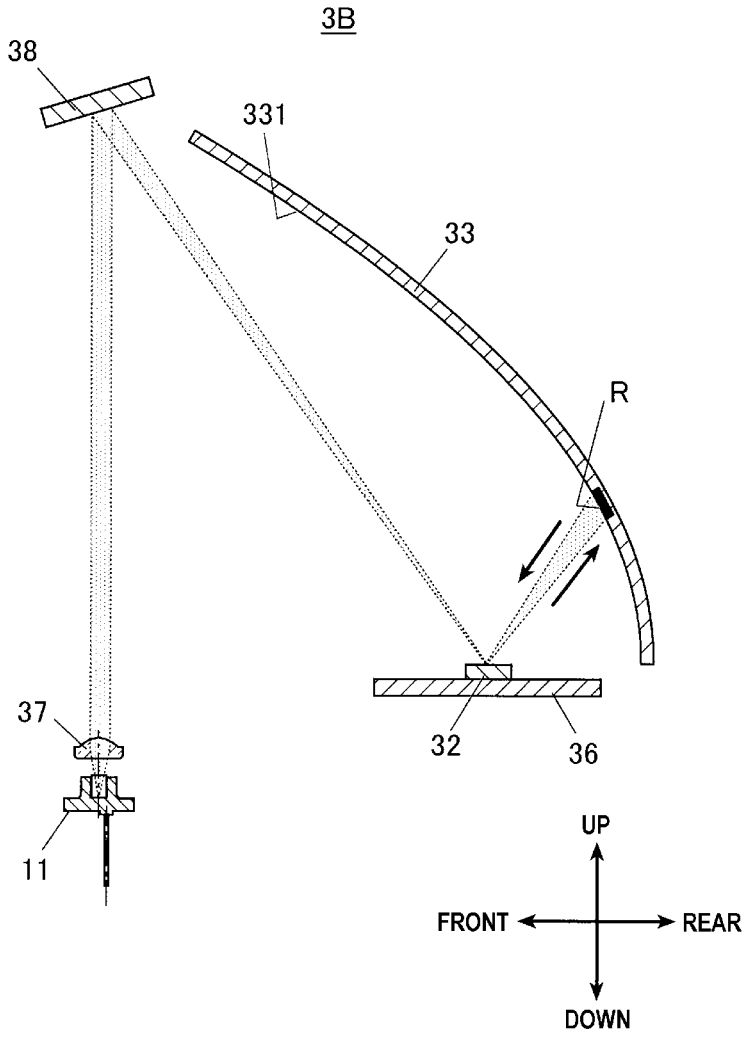
FIG. 13 is a cross-sectional side view of a vehicle light according to another variation of the exemplary embodiment of FIG. 10.

FIG. 13 is a cross-sectional side view of the vehicle light 3B according to this variation.

As shown in FIG. 13, the vehicle light 3B can include, instead of the diffusion portion D in the above described exemplary embodiment, a reflection portion R as an optical structure according to the presently disclosed subject matter.

The reflection portion R can be a third reflection surface portion formed in a portion of the reflection surface 331 on which the blue light having been condensed by the condensing lens 37 and the reflection minor 38 and regularly reflected from the phosphor 32 can be incident. This reflection portion R can reflect the blue light having been regularly reflected from the phosphor 32 without being converted into the white light and incident on the reflection surface 331 back to the phosphor 32.

In the above vehicle light 3B, the blue light having been regularly reflected from the phosphor 32 without being converted into the white light can be reflected from the reflection portion R back to the phosphor 32. Therefore, the blue light can be prevented from being projected out of the vehicle light. As a result, as in the above described exemplary embodiment, not only the color variations of the projected image can be prevented, but also the security of human bodies can be enhanced.

Furthermore, reflecting the blue light once having been regularly reflected from the phosphor 32 without being converted into the white light back to the phosphor 32 enables the blue light to be converted into the white light more efficiently. As a result, the light use efficiency can be improved when compared to the vehicle light 3 in the above described exemplary embodiment and the vehicle light 3A in the other variation thereof.

Another exemplary embodiment of the presently disclosed subject matter will now be described. The same components as those in the above described exemplary embodiment will be denoted by the same reference numerals, and a description will be omitted.

Figure 14:
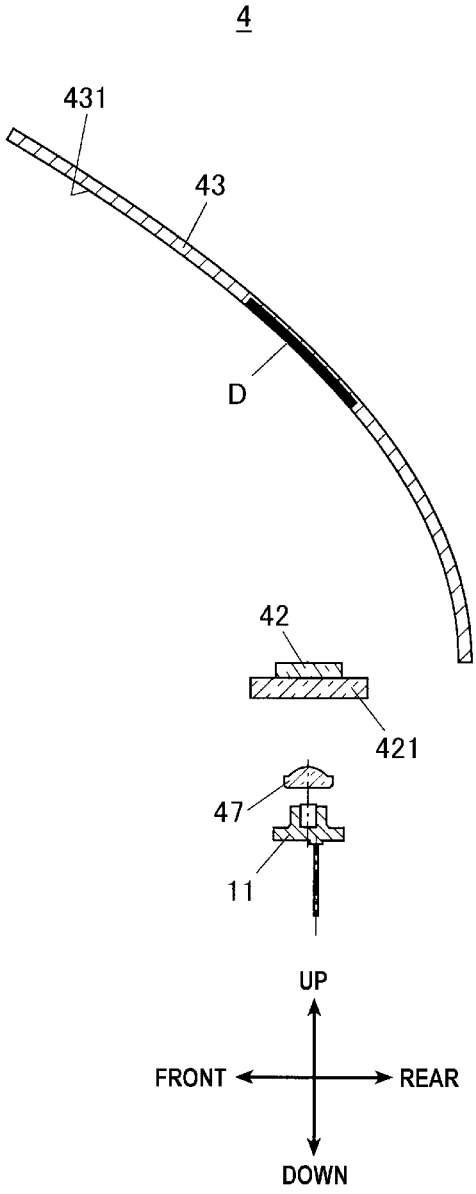
FIG. 14 is a cross-sectional side view of a vehicle light according to another exemplary embodiment.

FIG. 14 is a cross-sectional side view of a vehicle light 4 according to another exemplary embodiment of the disclosed subject matter.

As shown in FIG. 14, in addition to the LD 11 configured as in the above described exemplary embodiment, the vehicle light 4 can include a condensing lens 47, a wavelength conversion member including a phosphor 42, and a reflector 43. The vehicle light 4 can differ from the vehicle light 3 in the above described exemplary embodiment in that the vehicle light 4 is configured such that the blue light can be transmitted through the phosphor 42 from the lower surface to the top surface thereof.

The condensing lens 47 can be a condensing optical system according to the presently disclosed subject matter that can be disposed above the LD 11 and that can condense the blue light having been emitted upward from the LD 11 onto the lower surface of the phosphor 42 located above the condensing lens 47. More specifically, the condensing lens 47 can condense the blue light from the LD 11 into the phosphor 42 generally at the center of the phosphor 42 in the direction of thickness thereof through the surface thereof.

The phosphor 42 can be formed of the same fluorescent material as the phosphor 12 in the above described exemplary embodiments, and can be disposed above the condensing lens 47 with the lower surface of the phosphor 42 supported by a light transmissive member 421. This phosphor 42 is configured to receive the blue light having been emitted from the LD 11 and condensed by the condensing lens 47 through its lower surface and radially emit the white light upward. The phosphor 42 can also be formed such that the areas of the upper and lower surfaces thereof substantially correspond to that of the condensed spot of the blue light.

The reflector 43 can be formed into a curved plate that is opened in the forward direction, and can be disposed to cover the phosphor 42 from above. The lower surface (front surface) of the reflector 43 can include a reflection surface 431 facing to the top surface of the phosphor 42.

The reflection surface 431 can be a free-curved surface based on a revolved ellipsoid having a focal point at or near the position of the phosphor 42, and can reflect the white light having been emitted upward from the phosphor 42 toward the area forward of the vehicle.

Furthermore, the reflection surface 431 can include a diffusion portion D formed by roughening the surface thereof. The diffusion portion D can be formed in a portion of the reflection surface 431 on which the blue light having been condensed by the condensing lens 47 and transmitted upward through the phosphor 42 can be incident (see FIG. 15A). This diffusion portion D can be an optical structure according to the presently disclosed subject matter that can diffuse the blue light having been transmitted through the phosphor 42 without being converted into the white light in the phosphor 42 and incident on the reflection surface 431.

Figure 15B:
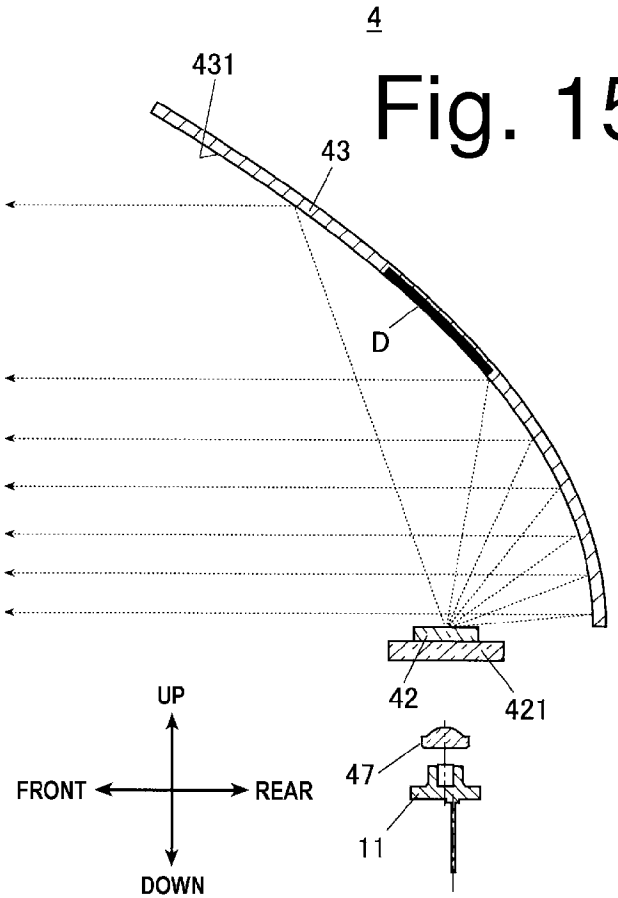
FIGS. 15A and 15B are cross-sectional side views illustrating the optical path in the vehicle light according to the exemplary embodiment of FIG. 14.
Figure 15A:
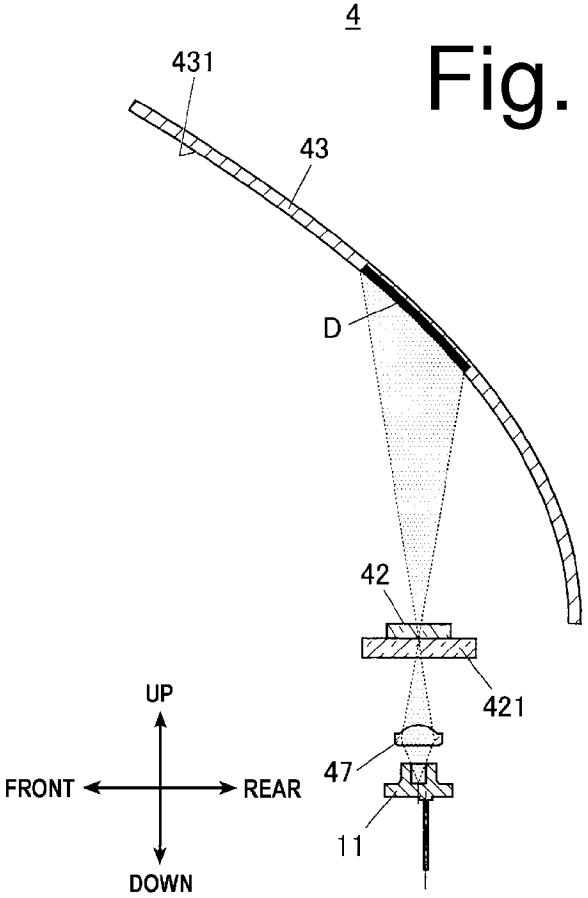

In the vehicle light 4 having the above configuration, as shown in FIG. 15A, the blue light (excitation light) emitted from the LD 11 can be condensed by the condensing lens 47 onto the phosphor 42, resulting in almost all the blue light being converted into the white light and emitted upward. In this process, although part of the blue light having been condensed into the phosphor 42 may be transmitted through the phosphor 42 toward the reflection surface 431 without being converted into the white light, that part of light can be received and diffused by the diffusion portion D of the reflection surface 431. As a result, the blue light can be prevented from being projected out of the vehicle light at the same strength as that at which the light has been emitted from the LD 11.

As shown in FIG. 15B, the white light emitted from the phosphor 42 can be reflected from the reflection surface 431 of the reflector 43 excluding the diffusion portion D, and can be projected toward the area forward of the vehicle. As a result, a predetermined high beam light distribution pattern can be formed.

In the above vehicle light 4, the same or similar advantages as the vehicle light 1 according to the above described exemplary embodiment can be obtained. More specifically, the blue light having been transmitted through the phosphor 42 without being converted into the white light in the phosphor 42 can be diffused by the diffusion portion D. Therefore, the blue light can be prevented from being projected out of the vehicle light at the same strength as that at which the light has been emitted from the LD 11. As a result, not only the color variations of the projected image can be prevented, but also the safety of human bodies can be enhanced.

Next, a vehicle light 4A according to a variation of the vehicle light 4 in the above described exemplary embodiment will be described. The same components as those in the above described exemplary embodiment will be denoted by the same reference numerals, and a description will be omitted.

Figure 16:
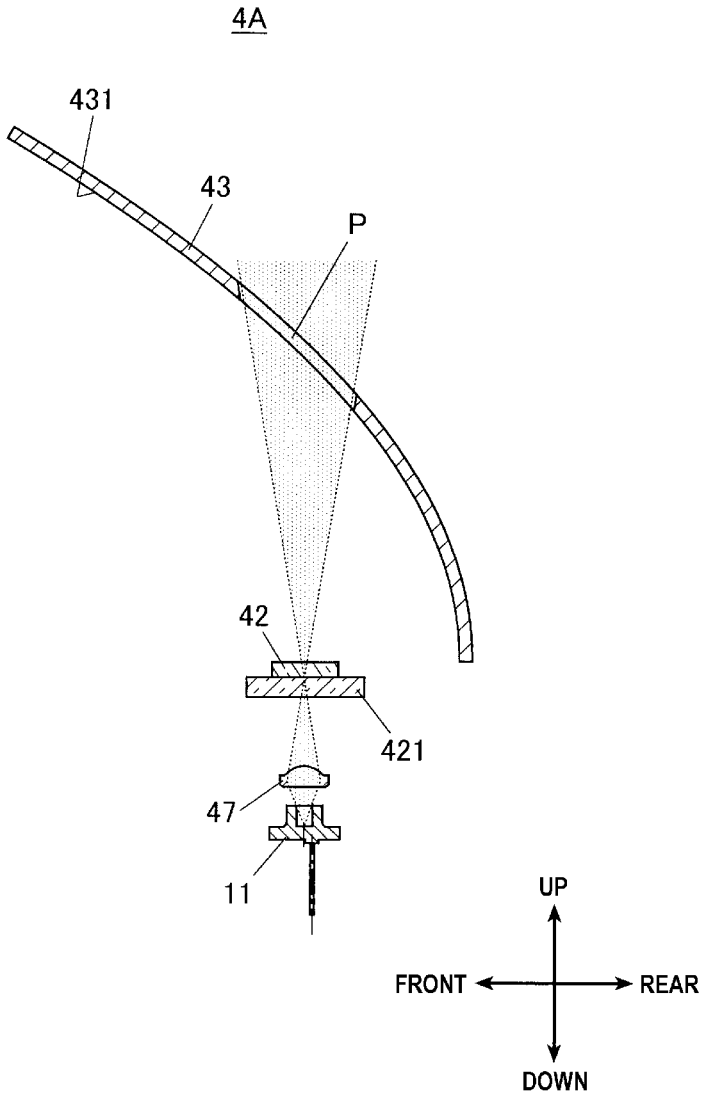
FIG. 16 is a cross-sectional side view of a vehicle light according to a variation of the exemplary embodiment of FIG. 14.

FIG. 16 is a cross-sectional side view of the vehicle light 4A according to this variation.

As shown in FIG. 16, the vehicle light 4A can include, instead of the diffusion portion D in the above described exemplary embodiment, a transmission portion P as an optical structure according to the presently disclosed subject matter.

The transmission portion P can be an opening for transmission formed in a portion of the reflection surface 431 on which the blue light having been condensed by the condensing lens 47 and transmitted through the phosphor 42 can be incident. This transmission portion P allows the blue light having been transmitted through the phosphor 42 without being converted into the white light in the phosphor 42 and incident on the reflection surface 431 to pass through the reflection surface 431 to the area rearward thereof.

In the above vehicle light 4A, the blue light having been transmitted through the phosphor 42 without being converted into the white light in the phosphor 42 can be transmitted through the reflection surface 431 to the area rearward thereof due to the transmission portion P. Therefore, the blue light can be prevented from being projected out of the vehicle light toward the area forward of the vehicle. As a result, as in the above described exemplary embodiment, not only the color variations of the projected image can be prevented, but also the safety of human bodies can be enhanced.

Next, a vehicle light 4B according to another variation of the vehicle light 4 in the above described exemplary embodiment will be described. The same components as those in the above described exemplary embodiment will be denoted by the same reference numerals, and a description will be omitted.

Figure 17:
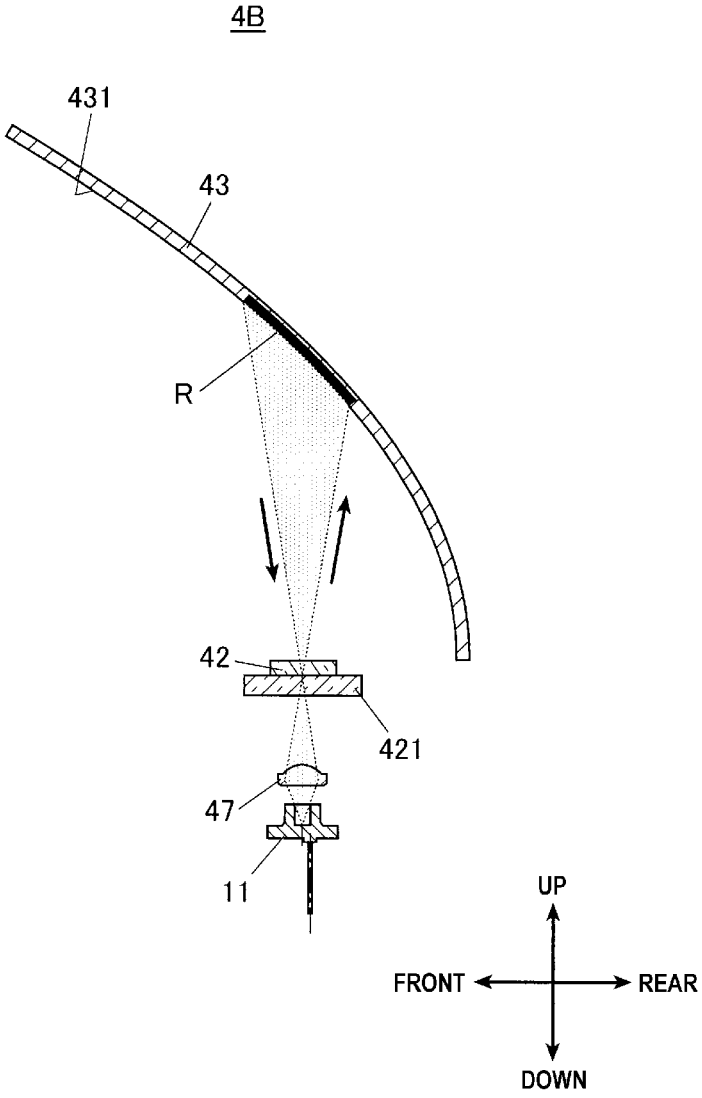
FIG. 17 is a cross-sectional side view of a vehicle light according to another variation of the exemplary embodiment of FIG. 14.

FIG. 17 is a cross-sectional side view of the vehicle light 4B according to this variation.

As shown in FIG. 17, the vehicle light 4B can include, instead of the diffusion portion D in the above described exemplary embodiment, a reflection portion R as an optical structure according to the presently disclosed subject matter.

The reflection portion R can be a third reflection surface portion formed in a portion of the reflection surface 431 on which the blue light having been condensed by the condensing lens 47 and transmitted through the phosphor 42 can be incident. This reflection portion R can reflect the blue light having been transmitted through the phosphor 42 without being converted into the white light in the phosphor 42 and incident on the reference surface 431 back to the phosphor 42.

In the above vehicle light 4B, the blue light having been transmitted through the phosphor 42 without being converted into the white light in the phosphor 42 can be reflected by the reflection portion R back to the phosphor 42. Therefore, the blue light can be prevented from being projected out of the vehicle light. As a result, as in the above described exemplary embodiment, not only the color variations of the projected image can be prevented, but also the safety of human bodies can be enhanced.

Furthermore, reflecting the blue light once transmitted through the phosphor 42 without being converted into the white light back to the phosphor 42 enables the blue light to be converted into the white light more efficiently. As a result, the light use efficiency can be improved when compared to the vehicle light 4 in the above described exemplary embodiment and the vehicle light 4A in the other variation thereof.

The presently disclosed subject matter is not limited to the above exemplary embodiments and the variations thereof, but can appropriately be modified, changed, or improved.

For example, although the semiconductor light-emitting element has been described as being a laser diode (i.e., the LD 11), the semiconductor light-emitting element is not limited thereto, and may be a light emitting diode.

Furthermore, although the LD 11 has been described as emitting blue light while the phosphors 12 to 42 have been described as using the blue light to emit yellow light, the presently disclosed subject matter is not limited thereto, and other configurations (combinations of excitation light and phosphors) that output white light may also be used. Furthermore, the light output from the phosphors 12 to 42 is not limited to white light, and visible light having a different color may also be output.

Furthermore, although the optical structures (the diffusion portion D, the transmission portion P, and the reflection portion R) according to the presently disclosed subject matter have been described as being formed in a portion on which the blue light having been regularly reflected from the phosphors 12 and 32 or the blue light having been transmitted through the phosphors 22 and 42 is incident, the optical structures need not be formed to fully cover that portion. More specifically, on the basis of the intensity of the blue light having been regularly reflected or transmitted through, the optical structure may be formed to partially cover the portion on which the blue light is incident, considering the extent to which the color variations of the projected image and the safety are affected. For example, the optical structure may be formed such that the intensity of the blue light is reduced to half the peak intensity of the blue light having been emitted from the LD 11.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle light comprising:

a light source including a semiconductor light-emitting element:

a wavelength conversion member disposed relative to the light source such that at least a portion of the light emitted by the light source is incident on the wavelength conversion member, wherein at least a portion of the light incident on the wavelength conversion member is wavelength converted;

a reflector including a first reflection surface and one of a diffusion member disposed adjacent to the first reflection surface, an opening in the first reflection surface and extending through the reflector, and a second reflection surface disposed adjacent to the first reflection surface, the reflector being a curved surface that is opened in a forward direction and being disposed to face one of first and second faces of the wavelength conversion member;

a condensing optical system configured to condense the excitation light emitted from the semiconductor light-emitting element, and a third reflection surface adjacent the first reflection surface;

wherein the first reflection surface is positioned relative to the wavelength conversion member such that visible light from the wavelength conversion member that is incident on the first reflection surface is reflected;

wherein the one of the diffusion member, the opening, and the second reflection surface is positioned on the reflector such that light from the light source that is incident on the wavelength conversion member and reflects off or passes the wavelength conversion member without wavelength conversion is received by the one of the diffusion member, the opening, and the second reflection member;

wherein the third reflection surface is disposed on a portion of the reflector such that light incident on the third reflection surface from the light source is condensed and directed toward the wavelength conversion member; and wherein the first reflection surface of the reflector other than the area of the optical structure is a reflection surface that can reflect all the visible light rays.

2. The vehicle light according to claim 1, wherein the third reflection surface is spaced from the reflector and positioned such that light incident from the light source is condensed and reflected toward the wavelength conversion member.

3. The vehicle light according to claim 1, wherein: the condensing optical system is positioned intermediate the light source and the wavelength conversion member such that light incident from the light source on the condensing optical system is condensed and transmitted to the wavelength conversion member.

4. The vehicle light according to claim 1, wherein the wavelength conversion member includes the first face directed toward the light source and the second face directed toward the reflector such that light from the light source and incident on the first face causes the wavelength conversion member to emit converted light from the second face toward the reflector.

5. The vehicle light according to claim 4, wherein the one of the diffusion member, the opening, and the second reflection surface faces toward the second face.

6. The vehicle light according to claim 4, further comprising:

a light transmissive member through which light from the light source passes during operation of the vehicle light, and wherein the light transmissive member supports the wavelength conversion member.

7. The vehicle light according to claim 1, wherein the semiconductor light-emitting element includes a laser diode.

8. The vehicle light according to claim 1, wherein the semiconductor light-emitting element includes a light-emitting diode.

* * * * *